US007212090B2

(12) United States Patent
Kadah

(10) Patent No.: US 7,212,090 B2
(45) Date of Patent: May 1, 2007

(54) RELAY WITH CORE CONDUCTOR AND CURRENT SENSING

(75) Inventor: Hassan B. Kadah, Hortonville, WI (US)

(73) Assignee: International Controls and Measurements Corporation, Cicero, NY (US)

( * ) Notice: Subject to any disclaimer, the term of this patent is extended or adjusted under 35 U.S.C. 154(b) by 226 days.

(21) Appl. No.: 11/019,880

(22) Filed: Dec. 22, 2004

(65) Prior Publication Data

US 2006/0132269 A1 Jun. 22, 2006

(51) Int. Cl.
*H01H 51/22* (2006.01)

(52) U.S. Cl. ..... 335/78; 361/160; 324/418

(58) Field of Classification Search ..... 361/160, 361/170, 185, 206, 209; 335/78–85; 324/418
See application file for complete search history.

(56) References Cited

U.S. PATENT DOCUMENTS 5,701,109 A * 12/1997 Poulsen ..... 335/78
5,874,876 A 2/1999 Kobayashi et al. ..... 335/128
6,320,486 B1 11/2001 Dietrich et al. ..... 335/78
6,563,409 B2 5/2003 Gruner ..... 335/136

* cited by examiner

*Primary Examiner*—Ramon M. Barrera
(74) *Attorney, Agent, or Firm*—Bernhard P. Molldrem, Jr.

(57) ABSTRACT

A relay situated in series between an AC line source and an AC load has a core conductor connected with the fixed N.O. contact, so that load current flows axially through the core of the actuator coil. Alternatively, the fixed N.C. contact may be connected with the core conductor. A plate armature with leaf springs can achieve linear axial action. A sensor connected to leads of a winding of the actuator coil picks up a an induced voltage that is representative of the current supplied to the load. This provides a simple arrangement for monitoring for current level and can be used for measuring power factor or ΔΦ at the load device. In a three phase embodiment, phase imbalance can be detected.

20 Claims, 4 Drawing Sheets

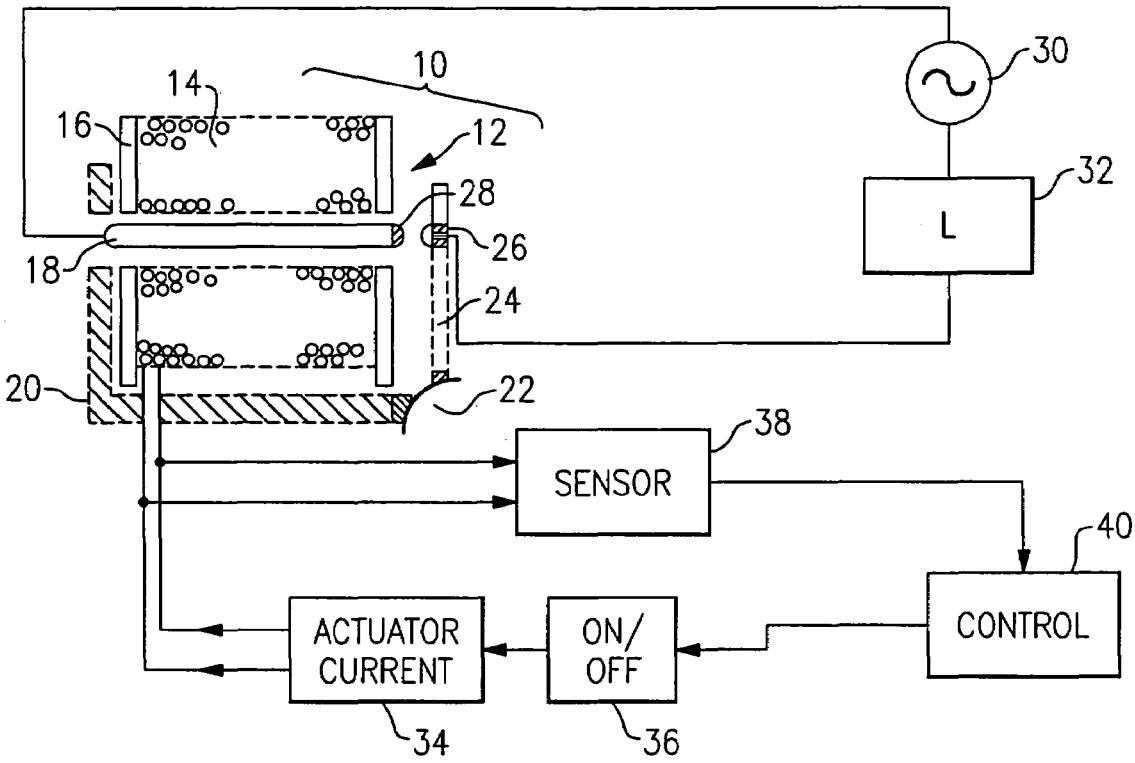
FIG.1
FIG.1A
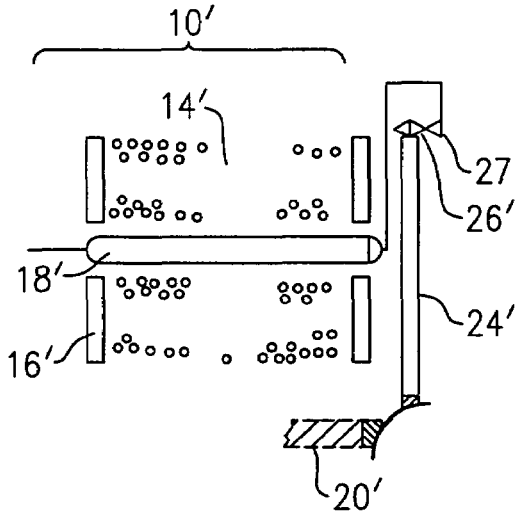

RELAY WITH CORE CONDUCTOR AND CURRENT SENSING

BACKGROUND OF THE INVENTION

This invention relates to electromagnetic relays and contactors, and is more specifically related to the structure of an electromagnetic or electromechanical relay of the type that has a winding or coil that is energized to move an armature such that a load current may be applied to a load device. Relays and contactors may be considered as devices in which the appearance of a pilot current or voltage causes the opening or closing of a controlled switching device to apply or discontinue application of load current. The invention is particularly concerned with a combination of a relay and a current sensor for measuring the amount of load current, or the quality thereof, that is being applied to the load device.

Electromagnetic or electromechanical relays or contactors are devices in which current that flows through an actuator coil closes or opens a pair of electrical contacts. This may occur in a number of well-known ways, but usually an iron armature is magnetically deflected towards the core of the coil to make (or break) the controlled circuit. In electromechanical relays, the voltage drop across the switching or output contacts is low, i.e., on the order of millivolts, so any power loss through the relay contacts is kept low in comparison with solid state relays, where the forward voltage drop may be one volt or sometimes higher.

Electromagnetic or electromechanical relays are commonly used to control the application of power to a load, for example, to control the application power to a blower or fan in a ventilation, heating, or air conditioning system. These devices are inexpensive and in general have good reliability over a reasonable life span. Wear of the contacts may occur in time due to arcing if the relay acts to break the circuit at a time when there is significant current load flowing. This may also produce switching noise, which may disturb electronic devices located near the relay.

If it is desired to monitor the load current to the associated load device, a separate current sensor is employed. This may involve a hall-type solid-state device or other current detector device. This adds circuit complexity and cost to the control circuitry for the load device.

OBJECTS AND SUMMARY OF THE INVENTION

Accordingly, it is an object of the present invention to provide an improvement to a relay or contactor that overcomes the above-mentioned drawback(s) of the prior art.

It is another object to provide a combination of an electromagnetic relay and load current sensor in which the coil or winding of the device plays a dual role.

It is a more specific object to provide a relay or contactor which permits monitoring of the quality of the load current that is being applied to the load device.

In accordance with one aspect of the present invention, an electromechanical relay may be situated in series with a source of AC line power and an AC load. Actuator current, i.e., pilot current, is applied to an actuator coil for closing and releasing a contactor arm of the relay, e.g., an armature.

Normally a spring or similar means biases the armature away from the actuator coil. A first, or moving, electrical contact carried on the armature; a second, or fixed electrical contact is adapted to make contact with the first contact when the actuator coil closes the armature. The second contact is connected to a core conductor that passes through an axial bore of the actuator coil. The coil picks up voltage that is induced by load current carried on the core conductor going to the AC load during the time that the actuator coil pulls in the armature. A load current sensor has input terminals connected to a winding of said actuator coil for picking up this induced voltage. This induced voltage is representative of the load current carried on the core conductor. The output from the sensor can be employed for controlling timing of opening or breaking of the load circuit so that the contacts are opened at a time when the applied current crosses through zero amperes. Also, the output of the sensor may be used to alert to high load conditions, i.e., lock rotor or stall; to very low load conditions, which may be indicative of blockage of air duct or filter, or to extremely low load conditions, which may be indicative of a drive belt failure or open circuit to the fan or blower motor. Comparison of the phase of the applied AC voltage and the AC load current can also be used to measure power factor or power phase angle, i.e., phase difference between voltage and load current.

Alternatively, an electromechanical relay (or contactor) is adapted to be situated in series with a source of polyphase AC line power (e.g., three-phase power) and the AC load. In this case, the contactor armature carries a plurality (e.g., three) of moving electrical contacts, each of which is coupled to a respective phase conductor. There are a respective plurality (e.g., two or three) of fixed electrical contacts adapted to make contact with the movable contacts when the actuator coil closes, i.e., pulls in the contactor armature. These fixed contacts are connected to respective core conductors that pass through the axial bore of the actuator coil, so that the three core conductors carry respective phase portions of the load current to the AC load. In this case, the load current sensor, whose input terminals are connected to a winding of the actuator coil, detects an induced voltage representative of the net of the respective phases of the load current. In a balanced system, the induced voltages from the three phases would cancel one another out, resulting in a zero reading. However, if there is a phase imbalance, an output level will appear, which can be used both to indicate the presence of an imbalance and to identify its phase.

The above and many other objects, features, and advantages of this invention will be more fully appreciated from the ensuing description of certain preferred embodiments, which are to be read in conjunction with the accompanying Drawing.

BRIEF DESCRIPTION OF THE DRAWING

FIG. 1 is an basic schematic view of a relay with load current sensing according to one embodiment of the present invention.

FIG. 1A shows an alternative relay arrangement.

DETAILED DESCRIPTION OF THE PREFERRED EMBODIMENT

Figure 2:
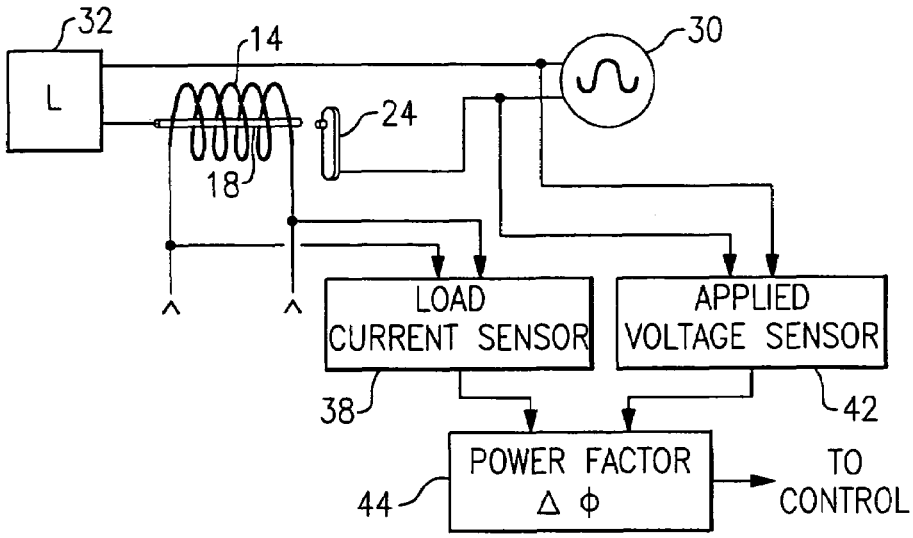
FIG. 2 is a schematic view of an alternative embodiment.

With reference now to the Drawing, FIG. 1 shows schematically a relay arrangement according to one embodiment of the invention. Here, an electromagnetic or electromechanical relay 10 has an electromagnet or actuator 12 formed of a wire coil or winding 14 wound upon a bobbin 16. A core conductor 18 is made of a conductive material, which may in some cases be ferromagnetic, that passes along the axis of the actuator 12 through an axial bore or passageway in the bobbin 16. A yoke 20 of ferromagnetic material supports the actuator coil and also supports a leaf spring 22 or other equivalent spring on which an iron armature 24 is mounted. The leaf spring 22 can be non-conductive or can be mounted on insulation so that the leaf spring 22 is electrically isolated from the yoke. The armature 24 pivots at the location of the spring 22, and is biased away from the actuator. A movable contact 26 is mounted on the armature and a fixed contact 28 is mounted on the core conductor. This contact 28 is the normally open or N.O. contact. Alternatively, the normally closed or N.C. contact could be used. There can be a permanent magnet or other means used for latching the relay upon actuation, in which case a reverse pulse may be employed to open the relay. Also, a manual reset provision, i.e., a relay reset button (momentary contact switch) can be used in some embodiments to open the relay after it has been actuated.

An AC power source 30, i.e., which may be standard household AC main line power or may be a synthetically generated power, is connected in a circuit that includes the core conductor 18, the contacts 26, 28 and an AC load 32, such that power is applied to the load 32 when the armature 24 is pulled in or closed, and power is cut off when the armature 24 is released.

A source circuit 34 for actuator current provides the pilot current or actuator current to the coil 14 of the relay, and this is controlled by a switch device or circuit, represented here by ON/OFF circuit 36. A voltage sensor circuit 38 is also connected to the leads to the coil or winding 14, and is sensitive to the voltage that is induced onto the coil by the AC load current that flows through the core conductor 18. This voltage is generally proportional to the magnitude of the load current, and provides a measure of the amount of current flowing through the AC load device 32. The phase of the AC load current is also available. An output of the sensor circuit 38 goes to an input of a control circuit 40, which may be operative to supply control signals to the ON/OFF circuit 36. In a heating, ventilation, or air conditioning environment, the control circuit 40 may be a portion of a furnace control board or air conditioning control board. In that case, it is useful for the control circuit to be sensitive to motor load current conditions on the blower motor, inducer motor, compressor motor, or other devices so as to assist in controlling the power or in some cases in adjusting the voltage and waveforms of the power flowing to those load devices. In addition, it is possible to generate an alarm if a fail condition is detected, such as lock rotor (high level) load current, or if an unusually low load current or absence of current is detected.

The fixed contact 28 may be positioned directly in line with the core conductor, or may be positioned elsewhere with a conductor leading to the core conductor, as design requirements may dictate.

An alternative relay arrangement shown in FIG. 1A includes a relay 10' in which its normally closed (NC) fixed contact is connected with the core conductor 18'. Here the elements that are correspond to the same element in FIG. 1 are identified with the same reference number but primed. The remainder of the circuit is omitted in this view.

Another embodiment of this invention is shown in FIG. 2, in which elements that are common also to the previous embodiment are identified with the same reference numbers as in FIG. 1, and do not need to be discussed in great detail. In this embodiment, in addition to the load current sensor 38, which is coupled to the leads of the coil 14, there is also a line voltage sensor 42 which measures the level of the main AC voltage that is applied from the AC source 30 to the load 32. The sensor may provide an integrated level that indicates the magnitude of the AC applied voltage, or in some cases it may provide the instantaneous voltage level, which may be useful in detecting the power factor or the phase difference $\Delta\Phi$ between the applied AC voltage and the AC current that flows through the core conductor 18 and the load 32. In such case, a power factor circuit 44, which may be of analog or digital design has inputs coupled respectively to the load current sensor 38 and to the voltage sensor 42, and its output may be provided to the control circuit 40.

Figure 3:
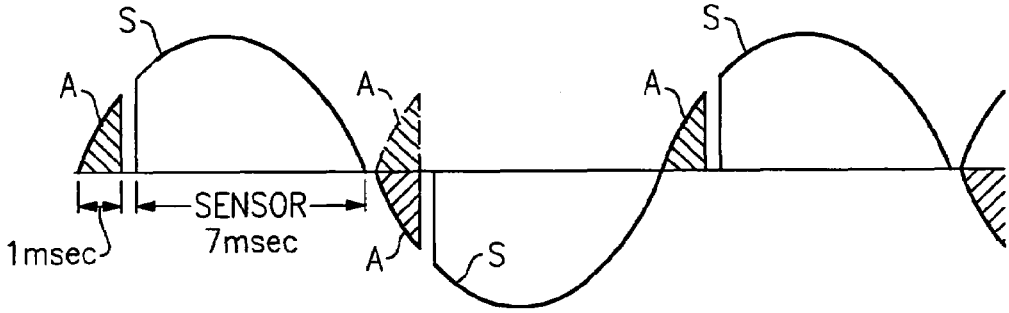
FIG. 3 is a chart for showing application of pilot current and sensing of induced voltage for explaining embodiments of this invention.

FIG. 3 is a wave chart showing the relation of the actuator current that is applied to the coil or winding 14 and the timing of the sensor 38 that detects the main load current flowing through the core conductor 18. This is one of many possible schemes that enables the same coil or winding 14 to be used both to pull in the armature 24 and also to provide an induced voltage to the sensor 38, without the two interfering with one another. This scheme may be employed when 24 volt AC thermostat power is used for actuation of the relay, and where the main AC source 30 provides 110 volt or 220 volt AC household power to the load device 32. Here, only a portion A of the AC wave (from the thermostat power) is employed for closing the relay 10, e.g., for a time of about one millisecond for each half cycle. This is rectified, e.g., in the actuator current source circuit 34, and may be integrated so as to maintain latch of the relay. The sensor 38 is turned off for this portion A, but may be turned on for any or all of a remaining sensor portion S, which is up to about 7 milliseconds for each half-cycle.

The core 18 may incorporate a permanent magnet. Then when the relay is to be actuated, the coil 14 is pulsed to actuate the load relay ON and then latches in the ON state. This allows the current sensor to read the entire line cycle. The relay can then be pulsed OFF by reversing the coil bias.

In the event that the actuator current is provided from a steady DC source, e.g., "battery", then the induced voltage that appears on the coil 14 and represents the load current would be superimposed on the DC voltage, and can be easily separated from it in the sensor 38. As another alternative, a separate, additional winding may be placed on the bobbin 16 of the relay 10 to be used for detecting the load current. A latching relay arrangement is also possible, employing a permanent magnet at the core, as is well known.

Figure 4:
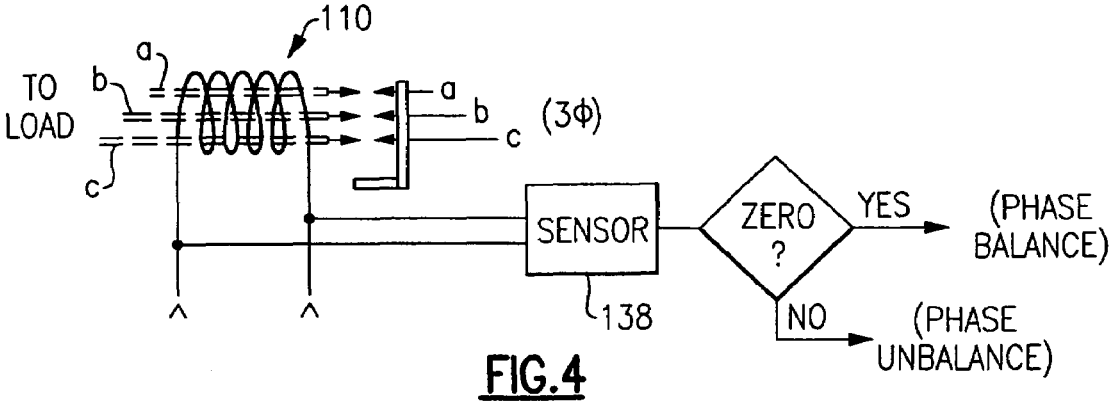
FIG. 4 is a schematic view of a three-phase embodiment of the present invention.

A polyphase version of the relay arrangement of this invention is illustrated in FIG. 4, in which elements that are similar to those in the previous embodiments are identified with similar reference numbers, but raised by 100. Here the relay 110 is configured as a three-phase relay or contactor, with a relay actuator coil 114 and with three separate core conductors 118*a*, 118*b*, and 118*c*, each carrying one phase of the three phase load power. There are three respective movable contacts 126*a*, 126*b*, and 126*c*, and three fixed contacts 128*a*, 128*b*, and 128*c*. The load and the source of AC power are omitted from this view. A load current sensor 138 is connected to the leads of the winding or coil 114, as in the previous embodiments. However, in this case, because the three phase conductors 118*a*, 118*b*, and 118*c* will be carrying currents that are mutually separated by 120 degrees, the effect of the voltage induced by the three phases of the load current will be to cancel one another out, provided the load is in balance. In this embodiment, a logic circuit 140 is connected with an output of the sensor 138, and indicates phase balance as long as the induced voltage is zero, but indicates an unbalanced condition if the induced voltage is different from zero, i.e, if there is a significant net load current. The threshold for this logic circuit 140 may be selected depending on the type of load.

Of course, by feeding only one of the three phases through a single core conductor, as with the embodiments of FIG. 1 and FIG. 2, it is possible to measure the magnitude of the load current for that phase, and also the phase angle thereof.

Figure 5:
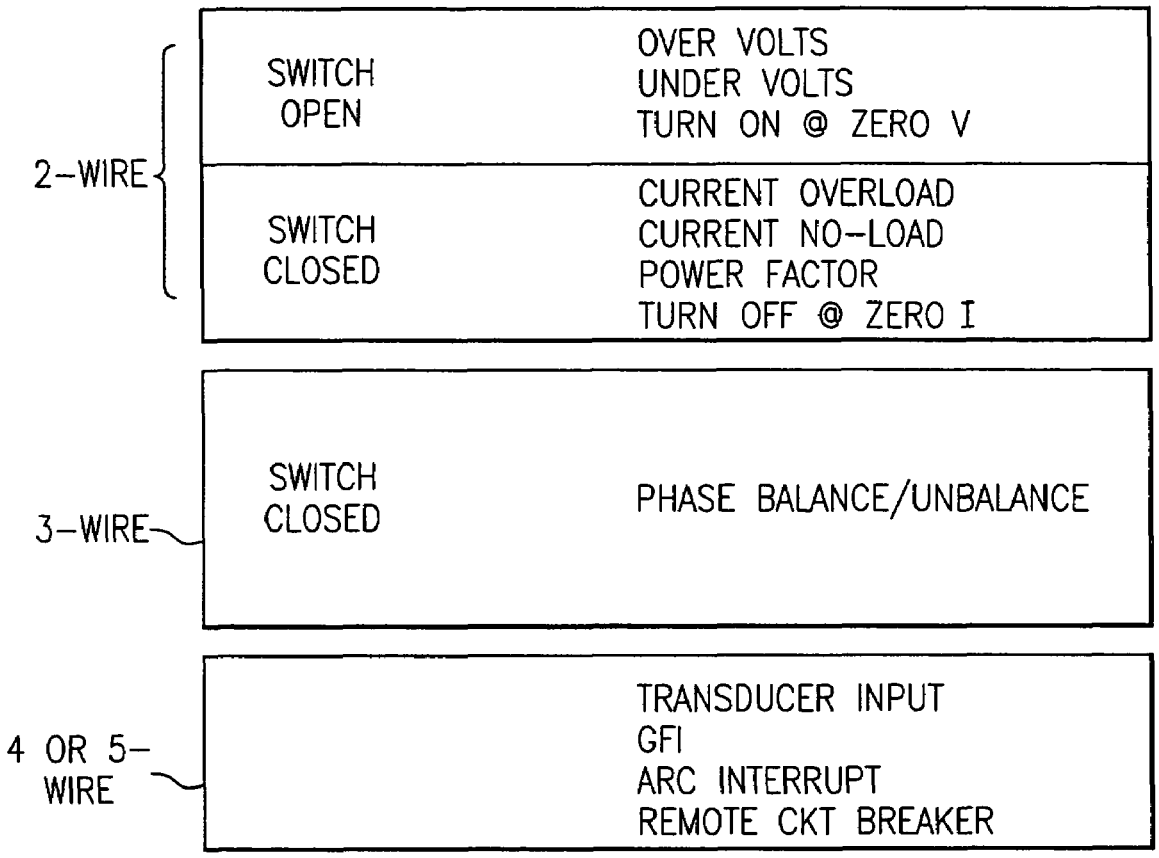
FIG. 5 is an applications chart for explaining various embodiments of embodiments of this invention.

FIG. 5 is a chart for explaining some of the capabilities and advantages of the various embodiments of this invention.

First, for a two-wire (e.g., single phase) embodiment such as that of FIG. 2, the line voltage detection facility of detector 42 can be used to measure the quality of the line voltage, i.e., whether there is an overvoltage problem or an undervoltage (brown-out) problem, and this information may be used to determine whether the device should be disabled. The timings of the zero-crossings of the applied line voltage are also available, and these may be used to control the timing of the actuator power, i.e., pilot current that is applied to the relay coil 14, so that the armature is pulled in and contact is made at a time when the line voltage is at or near zero.

When the relay switch is closed and current is flowing through the load 32 and through the center or core conductor 18, measures of the quality of the load current can be provided by the load current sensor 38, and the load current may be monitored for current overload and current no-load conditions, and for power factor or current-voltage phase difference AD. The timing of the load current zero crossings is also available, so that the timing of the release of the relay can be controlled so as to break contact when at the time that the AC load current is at or near zero amperes.

As discussed in respect to FIG. 4, the three-wire relay arrangement provides a simple and direct means to indicate phase balance and unbalance during the time that the switch is closed and the three-phase AC load current is flowing.

In a four-wire or five-wire arrangement, the detected load current value can be employed as a transducer input, for ground-fault isolation, arc interrupt, or for remote circuit breaker control.

Another embodiment is shown in FIGS. 6 to 9, in which the moving contact(s) are supported on a linear-action armature rather than a swing arm, so that the motion upon closure and release is along an axis of the actuator coil. This has the advantage of predictable alignment of the contacts when the relay is manufactured, for better, chatter-free closure. In addition, as the contacts wear over time, the contacts stay in alignment and avoid drift in alignment of the type that can occur in hinged or pivot action armatures. Here, similar parts to those of the previous embodiment are identified with the same reference numbers but raised by 200.

In this relay 210, the actuator coil 214 has a core conductor 218 disposed along its axis with a fixed core contact 228 at one end. The ferromagnetic yoke 220 provides a magnetic return path from the back to the front of the coil 214. A magnetic movable armature 224 is in the form of a generally rectangular plate (See FIGS. 8 and 9) having a plurality of spring clips or leaf springs 122 disposed at its edges, here two sets of two leaf spring clips 222, 222, one set along the left edge and one set along the right edge. In this embodiment, these spring clips 222 are of generally S-shaped profile to accommodate the axial motion of closure, and also to hold the armature by spring action against an associated support conductor 230. The moving contact 226 is affixed into a central apertured recess 229 in the plate or armature 224. The contact 226 can be in the form of a two-sided rivet type contact so as to be used in both normally open and normally closed operation.

The plate or armature 224 may be formed of spring steel, preferably a good conductor (e.g., Fe—Ni) of suitable springiness and magnetic permeability. Alternatively, the plate 224 can be formed of beryllium copper, and a ferromagnetic layer, e.g., Invar, can be mounted onto it.

A fixed contact 227 is mounted in axial alignment with the contact 226 on a conductive support member 231. The support member has a contact blade 232 extending upward and a lower conductive foot 233 for penetrating an aperture in a printed circuit board.

In this embodiment, the contact 227 serves as normally closed contact, and the contact 228 serves as normally open contact.

The four S-shaped spring clips 222 provide balanced spring force so that the motion of the armature plate 224 is in the linear direction along the axis of the coil 214. The clips 222 also provide electrical continuity between the contact 226 and the support conductor 230, which serves as a common terminal.

Figure 6:
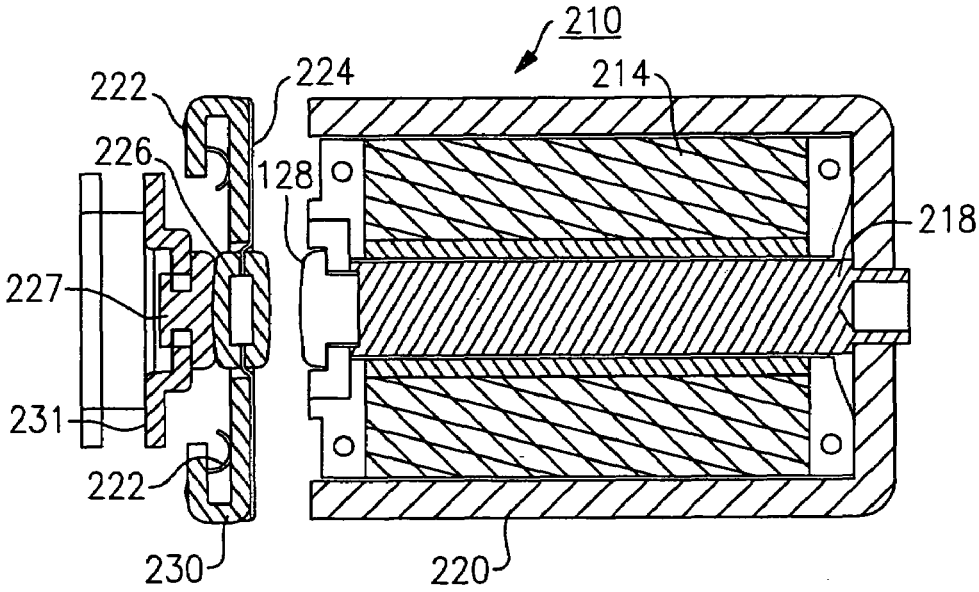
FIG. 6 is a sectional view of a linear action relay according to another embodiment of the invention.
Figure 7:
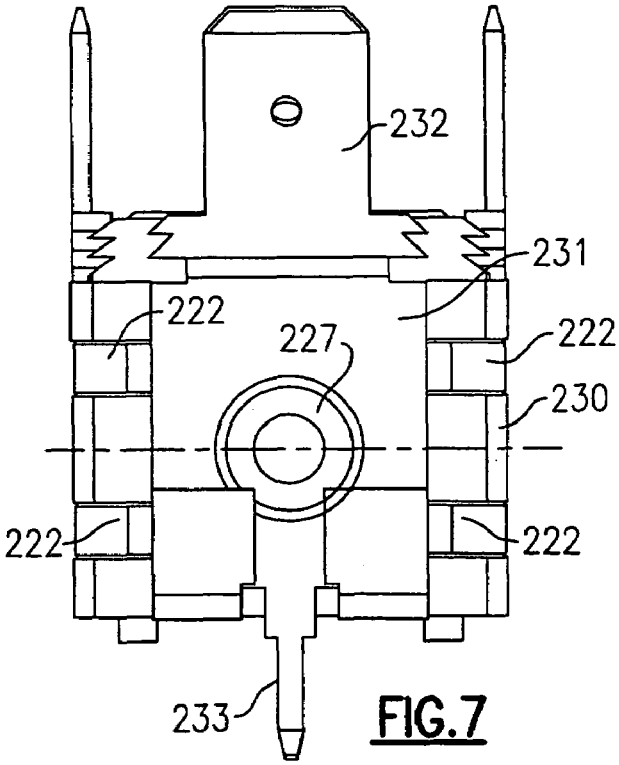
FIG. 7 is an end elevation thereof.
Figure 8:
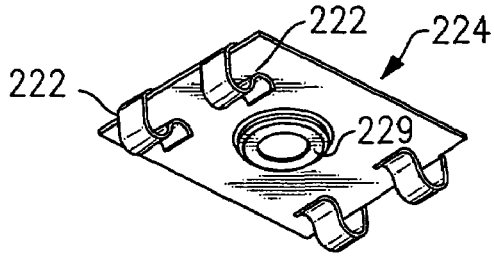
FIG. 8 is a perspective back view of a spring contactor member of this embodiment.
Figure 9:
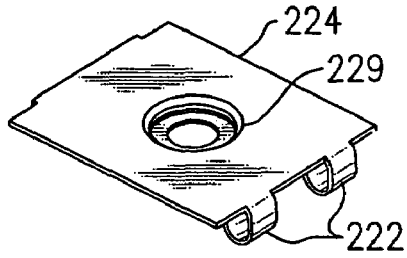
FIG. 9 is a perspective front view of the contactor member.

As shown in FIG. 6, the spring action armature plate 224 is normally biased against the support conductor 230, but is held about 0.006 inches away from the support conductor by engagement of the contacts 226 and 227. This creates a spring bias holding the contacts in normal electrical engagement. Upon application of actuator current through the coil 214, the armature plate 224 is pulled towards the coil 214, and the contact 226 pushes against the normally open contact 228. When the actuator current is terminated, the spring clips 222 return the actuator plate back away from the coil 214.

In this embodiment, a smaller holding current can be employed once the relay has been actuated, e.g., the actuator can be reduced to about thirty percent of its initial level after actuation. The relay will hold in the closed or actuated condition until the actuator current is removed. A small momentary reverse current may be applied in some cases for faster opening action.

The current along the core conductor 218 can be sensed by the main winding or by an auxiliary winding in the coil 214 and used in a manner as described in respect to the prior embodiments. Also, relays of this construction could be employed in DC applications.

While the invention has been described with reference to specific preferred embodiments, the invention is certainly not limited to those precise embodiments. Rather, many modifications and variations will become apparent to persons of skill in the art without departure from the scope and spirit of this invention, as defined in the appended claims.

I claim:

1. An electromechanical relay adapted to be situated in series with a source of AC power and an AC load, the relay comprising an actuator coil to which an actuator current is controllably applied for closing and releasing a contactor armature of the relay, the contactor armature including means normally biasing the contactor armature away from the actuator coil and a first electrical contact carried on said contactor member; a second electrical contact adapted to make contact with said first contact when the actuator coil is in a state that is either moved towards said contactor armature, or is biased away from the contactor armature, the second contact being connected to a core conductor that passes through an axial bore of said actuator coil, the core conductor carrying load current to said AC load when said actuator coil closes said contactor armature; and a load current sensor having input terminals connected to a winding of said actuator coil for picking up an induced voltage representative of the load current carried on said core conductor.

2. The relay according to claim 1, further comprising an actuator current circuit providing pulses of actuator current over a limited predetermined portion of at least selected cycles of AC applied power, and wherein said sensor measures the induced voltage over a remaining portion of said AC applied power.

3. The relay according to claim 2, further comprising a control circuit for controlling application and termination of the actuator current to said actuator coil, and said sensor circuit has an output coupled to an input of the control circuit, such that one or both of the application and termination of said actuator current may be synchronized to zero crossings of said load current.

4. The relay according to claim 1, further comprising a load voltage sensor connected across said AC load and measuring the voltage of the AC power applied thereto, and a power factor circuit having inputs coupled respectively to said load current sensor and said load voltage sensor and providing a motor current quality output signal.

5. The relay according to claim 4, wherein said power factor circuit provides a phase angle signal representative of the phase angle difference as between the applied AC voltage and the load current.

6. The relay according to claim 1, wherein said second electrical contact is a Normally Closed contact and is adapted to make contact with said first contact when said contactor member is released but to break contact when the actuator coil closes said contactor member.

7. The relay according to claim 6, further comprising an actuator current circuit providing pulses of actuator current over a limited predetermined portion of at least selected cycles of AC applied power, and wherein said sensor measures the induced voltage over a remaining portion of said AC applied power, and further comprising a control circuit for controlling application and termination of the actuator current to said actuator coil, and said sensor circuit has an output coupled to an input of the control circuit, such that one or both of the application and termination of said actuator current may be synchronized to zero crossings of said load current.

8. The relay according to claim 6, further comprising a load voltage sensor connected across said AC load and measuring the voltage of the AC power applied thereto, and a power factor circuit having inputs coupled respectively to said load current sensor and said load voltage sensor and providing a motor current quality output signal.

9. The relay according to claim 8, wherein said power factor circuit provides a phase angle signal representative of the phase angle difference as between the applied AC voltage and the load current.

10. The relay according to claim 1, the relay being adapted to be situated in series with a source of polyphase AC power and an AC load, and comprising a plurality of first electrical contacts carried on said contactor member, each said first contact being coupled to a respective phase conductor of said source; a respective plurality of second electrical contacts adapted to make contact with said first contacts when the actuator cod moves said contactor member to one of a closed position and a released position, with the second contacts being connected to respective core conductors that pass through the axial bore of said actuator coil, the core conductors carrying the respective phase portions of the load current to said AC load when said actuator coil moves said contactor member to said one of its open and closed positions; and wherein said load current sensor is operative for picking up an induced voltage representative of the net of the respective phases of said load current carried on said core conductors.

11. The relay according to claim 10, comprising a phase balance detector circuit having an input coupled to an output of said load current sensor.

12. The relay according to claim 1, wherein said contactor member includes spring members normally biasing the contactor member away from the actuator coil in a linear direction along an axis of the actuator coil.

13. The relay according to claim 12, wherein said contactor member includes a plate of a ferromagnetic material; with said spring members including a plurality of spring clips disposed at edges of said plate; and a support member situated axially of said actuator coil wit said spring clips being in spring contact with said support member for holding said plate in place on said support member and biasing said plate axially away from said actuator coil, such that the plate moves axially toward said actuator coil when said actuator current is applied thereto.

14. The relay according to claim 13, wherein said spring clips each are a leaf spring of a double-curved S-shaped profile.

15. The relay according to claim 13, wherein said plate has a central apertured recess on which said first contact is mounted.

16. The relay according to claim 1, wherein the contactor member includes spring members normally biasing the contactor member away from the actuator coil in a linear direction along the axis of the actuator coil; said first contact is a moving electrical contact carried on said contactor member and positioned along the axis of said actuator coil; and said second fixed electrical contact held at a fixed position relative to said actuator coil along said axis; such that said first and second contacts are urged into one of an open and closed condition when said actuator current is applied to the actuator coil, and are urged into the other of said open and closed conditions when said actuator current is removed from said actuator coil.

17. The relay according to claim 16, wherein said contactor member includes a plate of a ferromagnetic material; with said spring members including a plurality of spring clips disposed at edges of said plate; and a support member situated axially of said actuator coil with said spring clips being in spring contact with said support member for holding said plate in place on said support member and biasing said plate axially away from said actuator coil, such that the plate moves axially toward said actuator coil when said actuator current is applied thereto.

18. The relay according to claim 17, wherein said spring clips each are a leaf spring of a double-curved S-shaped profile.

19. The relay according to claim 17, wherein said plate has a central apertured recess on which said first contact is mounted.

20. The relay according to claim 1, wherein said second electrical contact is a Normally Open contact, and is adapted to make contact with said first contact when the actuator closes said contactor member, but to break contact when the contactor member is released.

* * * * *

UNITED STATES PATENT AND TRADEMARK OFFICE

CERTIFICATE OF CORRECTION

PATENT NO. : 7,212,090 B2
APPLICATION NO. : 11/019880
DATED : May 1, 2007
INVENTOR(S) : Hassan B. Kadah It is certified that error appears in the above-identified patent and that said Letters Patent is hereby corrected as shown below:

| | |
|---|---|
| Col. 6, Line 3: | "AD" should read -- $\Delta\Phi$ -- |
| Col. 8, Claim 10, Line 47: | "cod" should read -- coil -- |
| Col. 9, Claim 13, Line 2: | "wit" should read -- with -- |

Signed and Sealed this

Third Day of July, 2007

JON W. DUDAS
*Director of the United States Patent and Trademark Office*